United States Patent [19]

Yonker

[11] 4,039,026

[45] Aug. 2, 1977

[54] KICKOVER TOOL

[75] Inventor: John H. Yonker, Dallas, Tex.

[73] Assignee: Otis Engineering Corporation, Dallas, Tex.

[21] Appl. No.: 705,348

[22] Filed: July 14, 1976

Related U.S. Application Data

[63] Continuation of Ser. No. 587,400, June 16, 1975, abandoned.

[51] Int. Cl.[2] ..... E21B 7/06

[52] U.S. Cl. ..... 166/117.5; 166/241

[58] Field of Search ..... 166/117.5, 241; 417/109

[56] References Cited

U.S. PATENT DOCUMENTS

| | | | |
|---|---|---|---|
| 2,679,903 | 6/1954 | McGowen, Jr. et al. | 166/117.5 |
| 3,282,349 | 11/1966 | Cobbs et al. | 166/241 |
| 3,381,754 | 5/1968 | Tompkins | 166/241 |
| 3,752,231 | 8/1973 | McGowen, Jr. et al. | 166/117.5 |
| 3,828,853 | 8/1974 | Neal | 166/117.5 |
| 3,867,983 | 2/1975 | Neal | 166/117.5 |
| 3,876,001 | 4/1975 | Goode | 166/117.5 |
| 3,889,748 | 6/1975 | Tausch | 166/117.5 |
| 3,891,032 | 6/1975 | Tausch et al. | 166/117.5 |

*Primary Examiner*—James A. Leppink
*Attorney, Agent, or Firm*—Vinson & Elkins

[57] ABSTRACT

A kickover tool for installing or retrieving well equipment from side pocket mandrels in which a centralizing device is ineffective as the tool is run and which has springs that move to a new position after this tool begins reverse movement in the well to kick the tool into a position to install or retrieve equipment when the tool reaches a side pocket mandrel.

11 Claims, 12 Drawing Figures

KICKOVER TOOL

CROSS REFERENCE TO RELATED APPLICATIONS

This application is a continuation of application, Ser. No. 587,400 filed June 6, 1975, now abandoned.

This abstract is neither intended to define the invention of the application which, of course, is measured by the claims, nor is it intended to be limiting as to the scope of the invention in any way.

BACKGROUND OF THE INVENTION

A. Field of the Invention

This invention relates to kickover tools and more particularly to kickover tools for running or retrieving well equipment such as gas lift valves and further relates to a kickover tool which may be used with highly deviated holes without special orientation devices.

B. Prior Art

With the advent of the side pocket mandrel, kickover tools have been utilized for installing and retrieving well equipment such as gas lift valves in the side pocket mandrels.

One form of kickover tool has a centralizing device with outwardly expansible centralizers, such as bow springs, positioned on the tool. (See U.S. Pat. No. 2,679,903, to McGowen, Jr., et al). These tools worked well with mandrels of circular cross-section. However, even though this form of kickover tool has been improved somewhat over the years (See Composite Catalog of Oil Field Equipment and Services, Vol. 24, p. 1102 (1960–1961) and Vol. 29, pp. 1040 and 1041 (1970–1971)), the tool has several deficiencies when used in oval mandrels. All of the tool's outwardly expansible centralizing bow springs are jointly confined at both ends. The bow springs, therefore, all flex together. When well equipment is to be installed or retrieved from a side pocket mandrel with an elliptical or oval cross-section, the tool cannot properly direct a valve into the side pocket. The improper alignment of the tool occurs because the minor axis of the side pocket mandrel will prevent expansion of two of the bow springs. The other spring or springs will also not expand properly because their support is tied to the springs which lie in the minor axis of the mandrel and thus, they cannot flex outward to engage the wall of the side pocket mandrel at its major axis. When the tubing is highly deviated this failure of all the centralizing bow springs to flex outward until they all contact the mandrel wall can be quite disastrous since if the side pocket is located above the axis of the bore of the side pocket mandrel, the kickover tool will be unable to be articulated sufficiently to install or retrieve a valve from the side pocket.

U.S. Pat. No. 2,664,162, discloses individually spring-actuated arms to deflect a kickover tool into the side pocket. The arms do not provide a kickover tool of the centralizing type since only one arm is actuated at a time. In addition, the forces capable of being generated by the disclosed spring system would probably be unable to articulate a kickover tool up into a side pocket above the bore of the mandrel in a highly deviated tubing string.

Some kickover tools, such as the aforementioned tool described in U.S. Pat. No. 2,679,903, utilize a swivel joint to connect the tool to a sub associated with either wire line or pump-down equipment. The swivel joint permits the tool to be kicked over into alignment with the side pocket under the action of the centralizers. However, with a highly deviated string of tubing and with the side pocket located below the axis of the side pocket mandrel bore, the force of gravity could cause the tool to pivot about the swivel joint and unintentionally fall into the side pocket.

U.S. Pat. No. 3,828,853 discloses the utilization of a sleeve to telescope over the swivel joint while the tool is being run in the tubing to maintain the tool in alignment with the connecting sub.

OBJECTS OF THE INVENTION

It is an object of this invention to provide a kickover tool of the centralizer spring type that will maintain an aligned position while being run, so that the tool cannot be kicked over or articulated into the side pocket of a side pocket mandrel, until the tool is actuated and which, when actuated will be fully operable in mandrels of any cross-sectional shape.

It is another object of this invention to provide a kickover tool with a centralizing device that will operate to kickover and articulate the tool in side pocket mandrels of all cross-sectional shape.

A further object of this invention is to provide a kickover tool wherein all the centralizing bow springs flex outwardly to engage the walls in mandrels of any cross-sectional shape.

These and other objects and features of advantage of this invention will become apparent from the drawings, the specification and the claims.

BRIEF DESCRIPTION OF THE DRAWINGS

In the drawings wherein like numerals indicate like parts, and wherein an illustrative embodiment of this invention is shown.

DESCRIPTION OF THE PREFERRED EMBODIMENT

Figure 1:
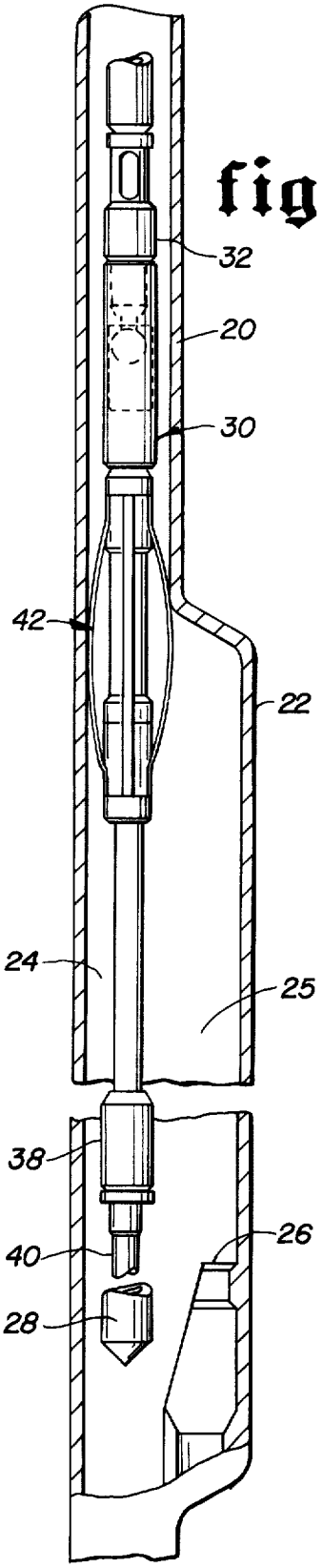
FIG. 1 is a view partly in elevation and partly in cross-section showing the tool of this invention being run past a side pocket mandrel.
Figure 2:
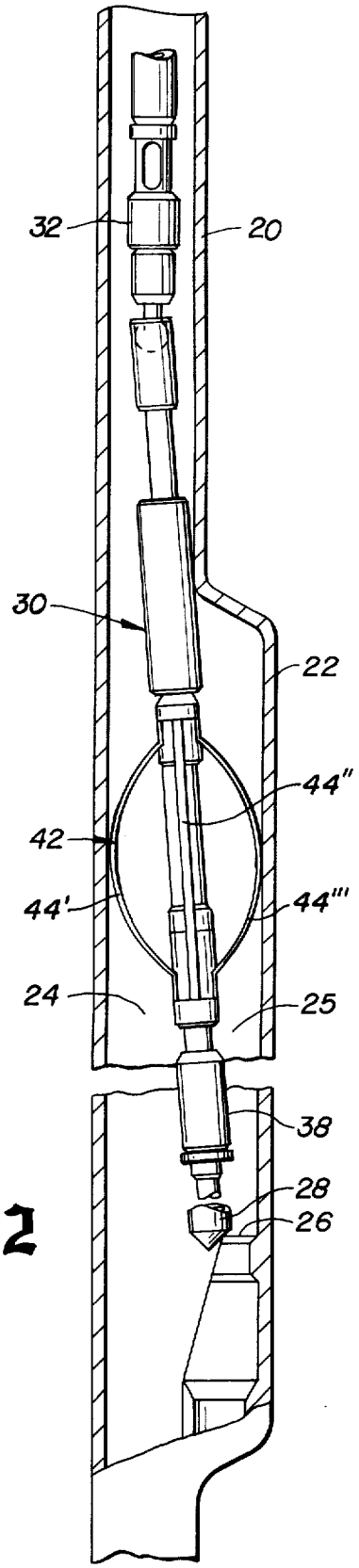
FIG. 2 is a view similar to FIG. 1 showing the tool in a kicked-over position.
Figure 4:
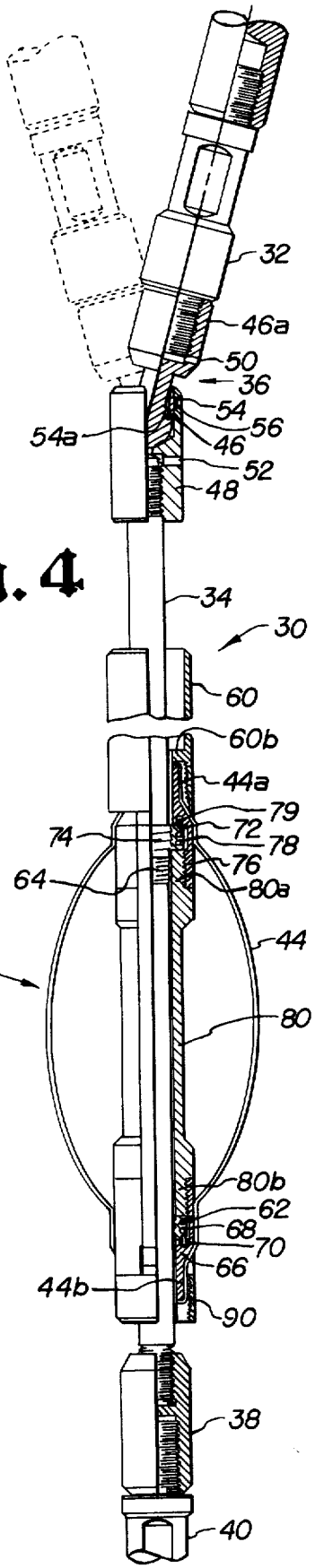
FIG. 4 is a view, partly in section and partly in elevation, of the kickover tool in a nonaligned, actuated position.

A tubing string 20 is normally run with a plurality of side pocket mandrels, one of which is indicated generally at 22 in FIGS. 1 and 2, at spaced points along the tubing 20. The side pocket mandrel 22 includes a bore 24 extending therethrough of generally the same size as and aligned with the bore of the tubing string 20 and also includes an offset 25 having a side pocket receptacle 26 for receiving and retaining well equipment, such as valve 28. The tubing 20 will be in a casing of a well for producing liquids. For simplicity of illustration, the well casing and the well are not shown.

A kickover tool, generally indicated at 30, is provided for installing or retrieving well equipment 28 from the side pocket receptacle 26. U.S. Pat. No. 3,610,336 which is incorporated herein by reference, explains the manner in which kickover tools are run on both wire lines and pump-down equipment. When a wire line is employed, the wire line is attached to upper sub 32; when pump-down equipment is used, the locomotive or piston is attached to sub 32. The preferred attachment is made through a set of jars so that a jarring force may be applied in the utilization of the kickover tool 30.

The kickover tool 30 includes an elongate body or mandrel 34 which is connected by a swivel connection indicated generally at 36 to upper sub 32 and is connected by a bottom sub 38 to a tool holder or spacer bar 40. The tool holder 40 is releasably attached to the well equipment 28 to be installed or retrieved from the side pocket receptacle 26 of the side pocket mandrel 22. The kickover tool 30 also includes a centralizing device indicated generally at 42. When the kickover tool 30 is being run in the tubing 20, the tubing walls flex the bow springs 44 of the centralizing device 42 inward. When the kickover tool 30 is being run through a side pocket mandrel 22, after the centralizing device 42 is within the asymmetrical enlargement created by the offset 25, the bow springs 44 flex outward until they impinge against the walls of the side pocket mandrel 22. The outwardly flexed bow springs 44 exert a force on the elongate body 34 tending to centralize it. If the body's 34 pivotal motion about sub 32 is not restricted, because of the force on the body 34, the body 34 pivots about the swivel connection 36 and the tool holder 40 is positiond to install or retrieve equipment 28 from the side pocket receptacle 26. As will be further explained, the kickover tool 30 is provided with two possible means for selectively maintaining the alignment of the body 34 with the sub 32. Even though the centralizing device 42 has entered the asymmetrical enlargement of the side pocket mandrel 22, the alignment maintaining means renders the bow springs ineffective to articulate the body 34 to a tool landing or retrieving position. The alignment maintaining means are selective and are operable when the kickover tool 30 is being run in the tubing 20. When the kickover tool is moved upward in the tubing, the alignment maintaining means are rendered inoperable and the bow springs 44 of the centralizing device 42 are rendered effective. The alignment maintaining means are releasably fastened in an operable position with the springs 44 ineffective and are fastened in an inoperable position with the springs 44 in an effective position.

The swivel connection 36 is conventional in form, and, as illustrated, is formed by having a ball 46 seat within a retainer housing 48. An extension 46*a* of the ball 46 is threadedly connected to the low end of upper sub 32 and the retaining housing 48 is threadedly connected to the upper end of elongate body 34. A locking pin 50 passes through the extension 46*a* and engages the upper sub 32 to maintain the threaded connection. In a like manner a pin 52 extends through the housing 48 and engages the body 34. The ball 46 is retained within the housing 48 by an annular retaining ring 54 with a downward facing internal slopped shoulder 54*a*. The retaining ring 54 fits in an internal annular recess 56 of the retaining housing 48.

Figure 3:
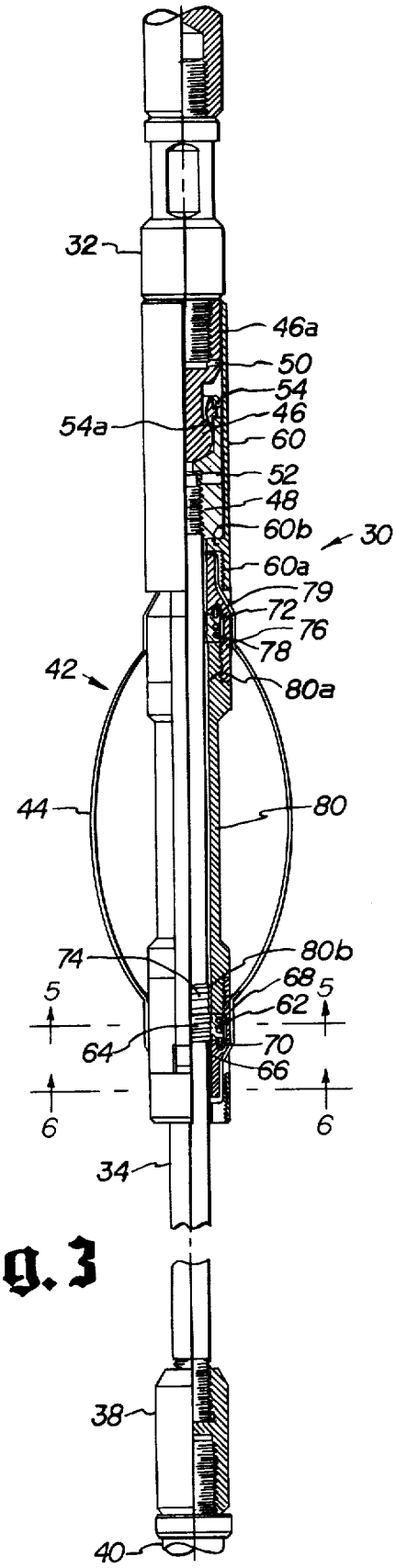
FIG. 3 is a view, partly in section and partly in elevation, of the kickover tool in an aligned, nonactuated position.
Figure 5:
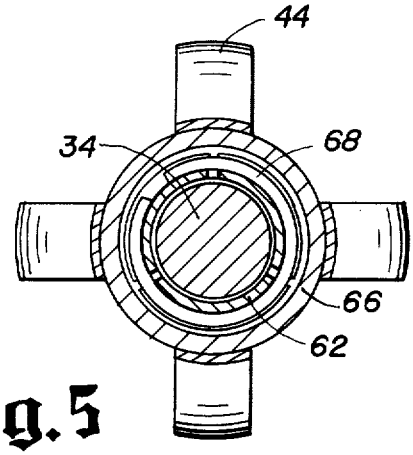
FIG. 5 is a view, partly in section and partly in elevation, taken along line 5—5 in FIG. 3.
Figure 6:
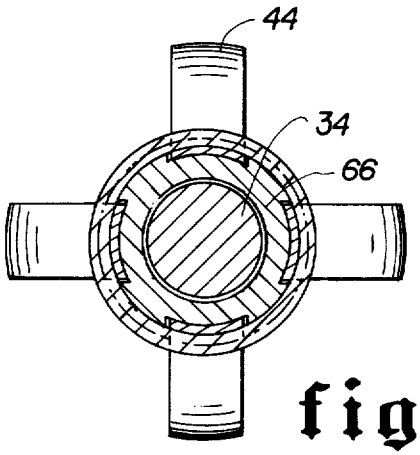
FIG. 6 is a view in section, similar to FIG. 5, taken along line 6—6 in FIG. 3.
Figure 7:
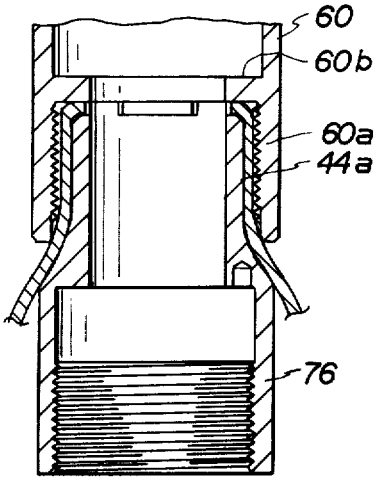
FIG. 7 is a longitudinal, sectional view showing the upper ratchet housing of the tool of FIGS. 3 and 4 together with a fragment of a spring and retainer.

A first means for selectively maintaining the alignment of the body 34 with the sub 32 is provided by a latch sleeve means 60 carried on the body 34. The latch sleeve means 60 is capable of releasably engaging the swivel connection 36 by telescoping over the retaining housing 48 and the ball extension 46*a* (FIG. 3). The confinement of the ball extension 46*a* and the retaining housing 48 within sleeve 60 results in the swivel connection 36 being rendered rigid with the body 34 and the upper sub 32 aligned. Preferably the upper sub 32 is a sufficient length and has a diameter relative to the internal diameter of the tubing bore 20 and side pocket mandrel bore 24 to maintain the kickover tool 30 in an aligned position in the side pocket mandrel 22 even though the centralizing device 42 has entered the asymmetrical portion of the side pocket mandrel 22. The engaged latch sleeve means 60 maintains the kickover tool 30 in its aligned position until after the well equipment 28 on the tool holder 40 passes the side pocket receptacle 26 of the side pocket mandrel 22. In this manner the kickover tool 30 can be run in the tubing 20 to any desired depth and the kickover tool 30 cannot kickover or articulate into the offset 25 of a side pocket mandrel 22 until the latch sleeve means 60 is released from engagement with the swivel connection 36.

When the kickover tool 30 is being run in the tubing 20 means are provided for releasably locking the latch means 60 in its engaged position wtih the swivel connection 36. When the tool is moved in an upward direction in the tubing 20, the releasable locking means releases the latch means 60 from engagement with the swivel connection 36. A second locking means is provided to prevent the latch means 60 from re-engaging the swivel connection 36. The illustrated locking means includes two sets of ratchet dogs which engage two sets of annular ratchet grooves on the body 34. The releasable locking means is provided by the engagement of a plurality of friction ratchet dogs 62 with ratchet grooves 64. The ratchet dogs 62 are positioned around the body 34 in a ratchet housing 66. At least one annular split compression ring 68 surrounds the ratchet dogs 62 to bias the ratchet dogs 62 inward against the body 34. A roll pin 70 fits in aligned recesses in one of the ratchet dogs and in the ratchet housing 66 to prevent rotation of the dogs 62 relative to the housing. The second locking means is provided by the engagement of a plurality of locking friction ratchet dogs 72 with locking ratchet grooves 74. Like the ratchet dogs 62, the locking ratchet dogs 72 are positioned around the body 34 in a ratchet housing 76, are surrounded by at least one annular split compression ring 78, and are prevented from rotating by a roll pin 79. To perform their respective locking functions, either the ratchet grooves 64 and 74 may be spaced on the body 34 with the ratchet dogs 62 and 72 adjacent each other or the ratchet dogs 62 and 72 may be spaced from each other with the ratchet grooves 64 and 74 adjacent. In the illustrated construction the ratchet grooves 64 and 74 are adjacent with grooves 74 being closer to the upper sub 32; the ratchet dogs 62 and 72 are spaced from each other with dogs 72 being closer to the upper sub 32. A spacing sleeve 80 maintains the spacing between the ratchet dogs 62 and 72. Both ends 80*a* and 80*b* of the spacing sleeve 80 have male thread connections which are received within female thread connections of the ratchet housing 76 and 66, respectively, to maintain the ratchets in spaced relationship.

The articulation of the kickover tool 30 occurs due to centralizing device 42 which includes a plurality of longitudinally disposed and outwardly biased bow springs 44 mounted on the body 34. To enable the kickover tool to be properly kicked over in mandrels of all cross-sectional shape, the bow springs 44 are capable of flexing independently. The kickover tool 30 having bow springs 44 that can flex independently of the flexing of any other bow spring 44 is properly kicked over, even in a side pocket mandrel of elliptical cross-section, because when two of the bow springs are flexed inward by the walls of the mandrel along its minor axis, the other bow springs can still flex outward until they impinge against the walls of the mandrel along its major axis. Thus, all the bow springs 44 impinge against the mandrel 22 walls to kickover and articulate the tool 30 so that the well equipment 28 can be installed or retrieved from side pocket receptacle 26.

As illustrated in FIG. 2, when the centralizing device 42 of the kickover tool 30 enters the eliptical cross-sectional portion of the side pocket mandrel 22, one of the bow springs 44' is capable of flexing outwardly to kickover the tool body 34 even though other bow springs 44'', (one spring 44'' being shown in FIG. 2, the other being behind the tool body 34), are confined inwardly by their engagement with the internal wall of the side pocket mandrel 22. Since the bow spring 44''' opposite the effective, articulating spring 44' flexes into the side pocket offset 25 it is ineffective and does not assist or inhibit the articulation of the tool 30 and the alignment of well equipment 28 with the side pocket receptacle 26.

Figure 8:
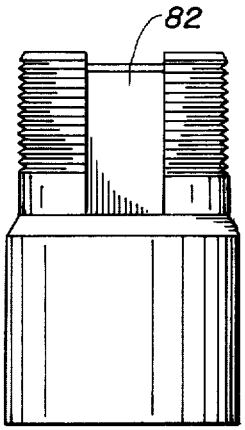
FIG. 8 is a side view of the ratchet housing in FIG. 7.
Figure 9:
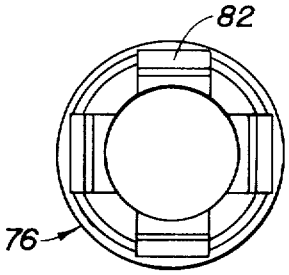
FIG. 9 is a top view of the ratchet housing in FIG. 7.

The preferred manner of providing the kickover tool 30 with independently flexible bow springs 44 is to mount the springs 44 on the tool 30 so that one end of each of the springs 44 is fixed and the other end is capable of movement. To fixedly mount one end of the bow springs 44 on the kickover tool 30 body 34, the upper ratchet housing 76 is provided with a male threaded end having a plurality of longitudinal grooves 82 (FIG. 8) extending coaxially with the axis of body 34 in which one end **44*a* of bow spring 44 are received. A spring retainer collar 60*a* provided by the lower end of latch 60 is threaded onto the ratchet housing 76. The spring retainer collar 60*a* thus surrounds the ends 44*a* of the bow springs 44 to prevent their outward radial movement and has an annular shoulder 60*b* to clamp the inturned ends 44*a* of the springs against the end 76*a* of the ratchet housing 76** and prevent their longitudinal movement.

Figure 10:
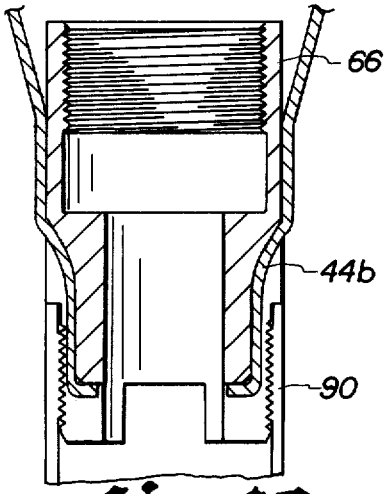
FIG. 10 is a longitudinal, sectional view showing the lower ratchet housing of the tool of FIGS. 3 and 4.
Figure 11:
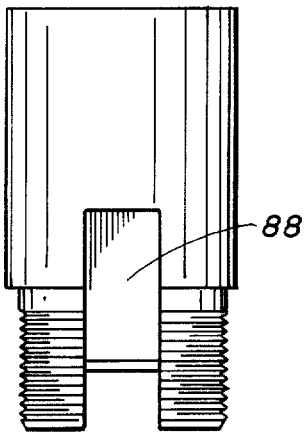
FIG. 11 is a side view of the ratchet housing in FIG. 10.
Figure 12:
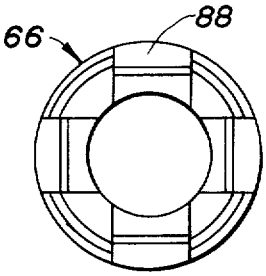
FIG. 12 is a bottom view of the ratchet housing of FIG. 10.

Preferably, the other ends **44*b* of the bow springs 44 are also mounted to prevent them from hanging up in the tubing 20 as the tool 30 is run. The illustrated mounting means prevents hangups of these ends 44*b* of the bow springs 44 and yet permits the bow springs 44 to independently flex by restricting the outward radial movement of the bow spring ends 44*b* while permitting longitudinal movement of the bow spring ends 44*b*. The lower ratchet housing 66 (FIG. 10) has a male threaded end with a plurality of longitudinal grooves 88 therein extending coaxially with the axis of body 34 in which the flexibly mounted ends 44*b* of the bow springs 44 will be received. A female threaded spring retainer collar 90 is threaded onto he ratchet housing 66 to confine the bow spring ends 44*b* against outward radial movement. Since the spring retainer collar 90 has no annular shoulder, the bow spring ends 44*b* are free to flex longitudinally in the grooves 88 of the lower ratchet housing 66**.

With the bow spring mounting means including the upper and lower ratchet housings 66 and 76, as above described, the bow springs 44 are slidably mounted on the body 34 and flex independently. As shown in FIG. 1, when the kickover tool 30 is being run in the tubing 20, the bow springs 44 are releasably secured in an upper position on the body 34. The releasable securing means is provided by the engagement of the friction ratchet dogs 62 with the ratchet grooves 64. Because the frictional engagement of the bow springs 72 with the inner walls of the tubing 20, upward movement of the tool 30 will cause the disengagement of the ratchet dogs 62 from the ratchet grooves 64 and the bow springs 44 will be released from the upper position on the body 34. The abutment of the lower spring retainer collar 90 with the connector 38 prevents excessive downward movement of the centralizer 42 with respect to he body 34. When the tool is moved downward again, the centralizer is secured by a second securing means in a position on the lower end of the body 34 (See FIG. 2). The second securing means is provided by the engagement of the locking friction ratchet dogs 72 with the locking ratchet grooves 74.

Preferably the second alignment maintaining means for the kickover tool is provided by the location of the centralizing device 42 on the body 34. When the kickover tool 30 is being run in the tubing 20 with the centralizing device releasably secured in an upper position on the body 34, the bow springs 44, although they do engage the walls of mandrel 22, are rendered ineffective and are unable to articulate the tool 30 into the offset 25 of mandrel 22 because, when the bow springs 44 have completely entered the asymmetrical portion of the mandrel 22 and become effective, the well equipment 28 at the lower end of the tool holder 40 has already been lowered past the side pocket receptacle 26. When a valve is being installed in the side pocket receptacle 26, the tool holder 40 can be short. However, when a valve is being retrieved from the valve seat 26 the tool holder 40 can be elongated. In either case, the tool holder 40 will be long enough so that the well equipment 28 is lowered past the side pocket receptacle 26 when the centralizing device 42 is within the enlarged asymmetrical portion of the side pocket mandrel 22. Raising the tool 30 in the tubing 20 releases the centralizing device 42 from its upper position. Upon entering the side pocket mandrel 22, the centralizing device 42 can align the well equipment 28 with the side pocket receptacle 26 since the equipment 28 is above the side pocket receptacle 26.

The operation of the improved kickover tool 30 may now be appreciated. When the tool 30 is being run in the tubing 20 it is prevented from unintentional articulation into a side pocket mandrel 22 by both the engagement of the latch sleeve means 60 with the swivel connection 36 maintaining the body 34 and the sub 32 in alignment and by the centralizing device 42 being in a noneffective position on the kickover tool 30. If desired, only one of these means for maintaining alignment during running of the tool 30 may be utilized. The latch sleeve means 60 is releasably locked in its engaged position and the centralizing device 42 is also releasably secured in its ineffective position. In this manner the tool 30 may be run to any desired depth in the tubing 20. Upward movement of the tool 30 results in both the latch sleeve means 60 being released from engagement with the swivel connection 36 and the centralizing device 42 being moved to a lower articulative position on the tool 30. The latch sleeve means 60 is locked in its released position so that it cannot re-engage the swivel connection 36. The centralizing device 42 is secured in its articulative, effective position. Now upon downward movement, when the centralizing device 42 enters a side pocket mandrel 22 it is able to kickover or articulate the tool 30 about the swivel connection 36. Beause the bow springs 44 independently flex, the well equipment 28 is aligned with the side pocket receptacle 26 when the tool is in its kicked over, articulated position no matter what type of cross-section mandrel 22 has. The alignment occurs because any one bow spring 44' (See FIG. 2) is capable of flexing outwardly independently of another bow spring 44" which will be confined inwardly by the internal wall of the side pocket mandrel 22 along its minor axis. Thus, a valve can be installed in the side pocket receptacle 26 or retrieved from the side pocket receptacle 26 by utilizing conventional running and retrieving equipment on the end of the kickover tool 30.

From the foregoing description it can be seen that the objects of the invention have been obtained. A kickover tool has been provided which has means for preventing the tool from unintentionally deflecting into a side pocket mandrel without the aid of orienting means. In addition the centralizing device provided for the tool is capable of engaging all the interior walls of a side pocket mandrel without regard to the cross-sectional shape of the mandrel.

The foregoing disclosure and description of the invention are illustrative and explanatory thereof and various changes in the size, shape and materials, as well as in the details of the illustrated construction may be made within the scope of the appended claims without departing from the spirit of the invention.

What is claimed is:

1. A kickover tool for running and retrieving well equipment in a side pocket mandrel of a tubing comprising:
- an elongate body;
- a centralizing device including:
  - a plurality of outwardly expansible longitudinal bow springs,
  - mounting means to mount said bow springs on said body,
  - each of said bow springs being capable of flexing independently of any other bow spring;
- means rendering said bow springs ineffective to kickover said body to a tool landing or retrieving position while the kickover tool is moving in a first direction through the tubing; and
- means rendering said bow springs effective to kickover said body to a tool landing or retrieving position upon movement of the kickover tool in another direction through the tubing.

2. A kickover tool for running and retrieving well equipment in a side pocket mandrel of a tubing comprising:
- an elongate body;
- a centralizing device including:
  - plurality of outwardly expansible longitudinal bow springs,
  - mounting means to slidable mount said bow springs on said body,
  - each of said bow springs being capable of flexing independently of any other bow spring;
- releasable means to secure said bow springs in an ineffective position when the tool is being run into the tubing in a first direction, said releasable means releasing said bow springs from their ineffective position upon movement of the tool in a second direction;
- and a second means to secure said bow springs in an effective position in which said bow springs are able to kickover said body so that well equipment may be set or retrieved upon subsequent movement of the tool in said first direction.

3. The kickover tool of claim 2 wherein said mounting means includes:
- a first collar in which one end of each of said bow springs is fixed; and
- a second collar in which the other end of each of said bow springs is mounted, said second collar restricting outward radial movement of said other end of said bow springs while permitting longitudinal movement of said other end of said bow springs.

4. A kickover tool for running and retrieving well equipment in a tubing comprising:
- a sub;
- an elongate body;
- a centralizing device including:
  - a plurality of outwardly expansible longitudinal bow springs,
  - mounting means to mount said bow springs on said body,
  - each of said bow springs being able to flex independently of any other bow spring;
- swivel connection means at one end of said body for connecting said body to said sub;
- latch means carried on said body releasable engaging said swivel connection means for maintaining said body and said sub in aligned position;
- means for releasable locking said latch means in a latched position with said swivel connection means when the tool is being run in one direction in the tubing, said releasable locking means releasing said latch means from engagement with said swivel connection means upon movement of the tool in the other direction; and
- a second locking means for locking said latch means in a non-engaged position with respect to said swivel connection whereby said bow springs, upon release of said latch means, are able to articulate said body about said swivel connection means so that well equipment may be set or retrieved.

5. The kickover tool of claim 4 wherein the latch means includes:
- a sleeve slidably carried on said body which telescopes over said swivel connection means to maintain said body and said sub in aligned position.

6. A kickover tool for running and retrieving well equipment in a tubing comprising:
- a sub;
- an elongate body;
- a centralizing device including:
  - a plurality of outwardly expansible longitudinal bow springs,
  - mounting means to mount said bow springs on said body,
  - each of said bow springs being able to flex independently of any other bow spring;
- a swivel connection means at one of said body for connecting said body to said sub;

latch means carried on said body releasable engaging said swivel connection means for maintaining said body and said sub in aligned position;

means for releasable locking said latch means in a latched, engaged position with said swivel connection means when the tool is being run in one direction in the tubing, said releasable locking means releasing said latch means from engagement with said swivel connection means upon movement of the tool in the other direction;

a second locking means for locking said latch means in a non-engaged position with respect to said swivel connection;

releasable securing means to secure said bow springs in a non-effective position when the tool is being run in one direction in the tubing, said releasable securing means releasing said bow springs from their non-effective position upon movement of the tool in the other direction; and a second securing means to secure said bow springs in an effective position in which said bow springs are able to articulate said body so that well equipment may be installed or retrieved.

7. The kickover tool of claim 6 wherein said mounting means includes:

a first collar in which one end of each of said bow springs are fixedly mounted; and a second collar in which the other end of each of said bow springs are mounted, said collar restricting outward radial movement of said other end of each of said bow springs while permitting relative longitudinal movement of said other end of said bow springs.

8. The kickover tool of claim 7 wherein said second collar surrounds the end of each of said bow springs and the end of said bow springs is confined between said collar and said body in a longitudinal slot whereby said bow springs are able to flex independently by the longitudinal movement of said bow spring ends in the longitudinal slots.

9. The kickover tool of claim 6 wherein the latch means includes:

a sleeve slidably carried on said body which telescopes over said swivel connection means to maintain said body and said sub in aligned position.

10. A kickover tool for running and retrieving well equipment in a side pocket mandrel of a tubing comprising:

an elongate body;

a centralizing device including:

a plurality of outwardly expansible longitudinal bow springs, mounting means to mount said bow springs on said body, one of said bow springs being capable of flexing independently of other bow springs mounted normal to it;

means rendering said bow springs ineffective to kickover said body to a tool landing or retrieving position while the kickover tool is moving in a first direction through the tubing; and means rendering said bow springs effective to kickover said body to a tool landing or retrieving position upon movement of the kickover tool in another direction through the tubing.

11. A kickover tool for running and retrieving well equipment in a side pocket mandrel of a tubing comprising:

an elongate body;

a centralizing device including:

a plurality of outwardly expansible longitudinal bow springs, mounting means to mount said bow springs on said body, one of said bow springs being capable of flexing outwardly to kickover said body when other bow springs are confined inwardly by the internal wall of the side pocket mandrel;

means rendering said bow springs ineffective to kickover said body to a tool landing or retrieving position while the kickover tool is moving in a first direction through the tubing; and means rendering said bow springs effective to kickover said body to a tool landing or retrieving position upon movement of the kickover tool in another direction through the tubing.

* * * * *